US005575275A

United States Patent [19]

Gazaille

[11] Patent Number: 5,575,275

[45] Date of Patent: Nov. 19, 1996

[54] FIRELOG BURNER TRAY WITH HEAT REFLECTOR

[76] Inventor: Guy Gazaille, 1276, Chantovent, Sainte-Adèle, Canada, J0R 1L0

[21] Appl. No.: 356,136

[22] Filed: Dec. 15, 1994

[51] Int. Cl.[6] ..... F23H 13/00

[52] U.S. Cl. ..... 126/540; 126/552; 126/152 R; 126/163 R

[58] Field of Search ..... 126/552, 533, 126/540, 528, 529, 92 B, 9 R, 9 B, 152 R, 148, 201, 25 R, 298, 541, 521, 522, 543, 163 R

[56] References Cited

U.S. PATENT DOCUMENTS

| | | | |
|---|---|---|---|
| Re. 15,577 | 4/1923 | Nichols | 126/552 X |
| 332,429 | 12/1885 | Pearson | 126/528 X |
| 365,360 | 6/1887 | Bayne et al. | 126/298 |
| 379,057 | 3/1888 | Dweyer | 126/552 |
| 3,213,846 | 10/1965 | Rodgers, Jr. et al. | 126/552 |
| 4,180,054 | 12/1979 | Romero et al. | 126/540 |
| 4,526,159 | 7/1985 | Vroome | 126/552 X |
| 4,759,340 | 7/1988 | Chong | 126/541 |
| 5,282,459 | 2/1994 | Soule | 126/552 |

FOREIGN PATENT DOCUMENTS

| | | | |
|---|---|---|---|
| 1197744 | 12/1985 | Canada | 126/540 |
| 439 | 2/1873 | United Kingdom | 126/540 |
| 23615 | 10/1906 | United Kingdom | 126/540 |
| 1369 | 10/1913 | United Kingdom | 126/540 |
| 162403 | 5/1921 | United Kingdom | 126/528 |
| 235975 | 7/1925 | United Kingdom | 126/148 |
| 267845 | 3/1927 | United Kingdom | 126/152 |

*Primary Examiner*—Carl D. Price
*Attorney, Agent, or Firm*—F. Martineau

[57] ABSTRACT

A firelog burner tray for supporting a firelog over ground, including: (a) a flat horizontal base plate, for supporting the firelog, the base plate being full and defining an aft edge portion; (b) an elongated heat-reflector, upwardly extending from the aft edge portion of the base plate; and (c) a number of forwardly extending ribs, lengthwisely extending along and integrally dependent from the heat-reflector, whereby vertical air draft channels are formed between each pair of laterally successive ribs, for promoting vertical through circulation of combustion air between the heat reflector and the firelog; wherein particulate emissions released to the environment are controlled, and forwardly reflected heat and combustion time are enhanced.

4 Claims, 3 Drawing Sheets

FIRELOG BURNER TRAY WITH HEAT REFLECTOR

FIELD OF THE INVENTION

This invention relates to andirons with an integral heat reflector, for supporting a firelog into a fireplace.

BACKGROUND OF THE INVENTION

Conventional andirons support firewood spacedly over ground, for promoting combustion airflow therebeneath. These known andirons are simply an arrangement of tubular members forming a generally open horizontal template supported spacedly over ground by upright corner legs. Because the horizontal template is generally open, there are at least three disadvantages follow: (a) combustion time is short, so that a relatively large number of wood logs must be fed to the fire to sustain the combustion; (b) particulate emissions levels are high, because lightweight ashes driven by fireborne air drafts are carried upwardly to the atmospherical environment, thus creating an atmospheric air pollution problem; and (c) the efficiency of the fire place forward-heat transfer is low, because most of the heat generated by the fire, instead of going forwardly into the room, escapes upwardly with the upwardly directed air drafts.

OBJECTS OF THE INVENTION

The gist of the invention is therefore to address the problems outlined in the background of the invention paragraph, by providing an andiron-like member with a full template member and an aft reflector member.

A corollary object of the invention is to provide enhanced forward heat transfer efficiency, without compromising the aesthetic appeal of the andiron-like member.

SUMMARY OF THE INVENTION

In accordance with the teachings of the invention, there is disclosed a firelog burner tray for supporting a firelog over ground, said tray including: (a) a flat base template member, for horizontally supporting the firelog, said template member being full and defining an aft edge portion; (b) an elongated heat-reflecting member, transversely extending from said aft edge portion of said template member, so that said heat-reflecting member is adapted to be upright; and (c) air channel means, for promoting combustion air flow between said upright member and the firelog; wherein particulate emissions released to the environment are controlled, and forwardly reflected heat and combustion time are enhanced.

Preferably, said upright member and said template members are integrally formed out of a single rigid sheet member, said sheet member being bent at an intermediate elbowed section thereof at right angle. Additional air channel means could be provided, for controlling air flow to the firelog on opposite lateral sides of said tray. At least two, and preferably four, inturned elongated ribs, being preferably cross-sectionally V-shape, could be further provided, extending longitudinally of said heat-reflecting sheet member and laterally spacedly from one another, said air channel means being formed between each pair of laterally successive said elongated ribs. Preferably, the lower ends of said elongated ribs extend short of said base template sheet member.

It is envisioned that said additional air channel means could consist of a pair of flanges, each flange edgewisely depending from the corresponding laterally opposite side edges of said sheet template member, said flanges being outwardly upwardly inclined.

Advantageously, andiron means would be provided, for self-supporting said sheet template member spacedly over ground. These andiron means could consist of a pair of sheet extension lips that transversely depend from corresponding said flanges integrally thereof, said lips being substantially orthogonal to said sheet template member, whereby said lips are adapted to form upright support legs.

DETAILED DESCRIPTION OF THE DRAWINGS

Figure 1:
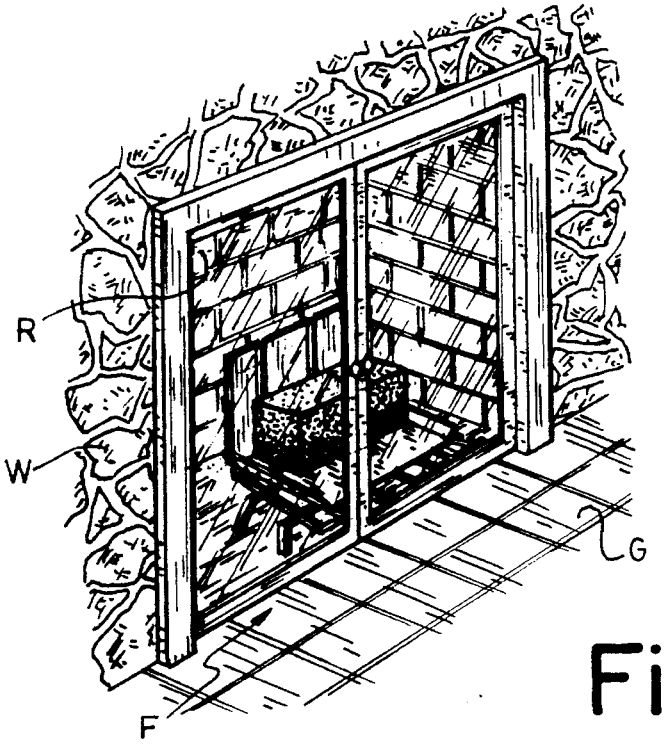
FIG. 1 is a perspective view of a fireplace, showing a first embodiment of firelog burner tray of the invention supporting a single transversely-extending firelog.
Figure 2:
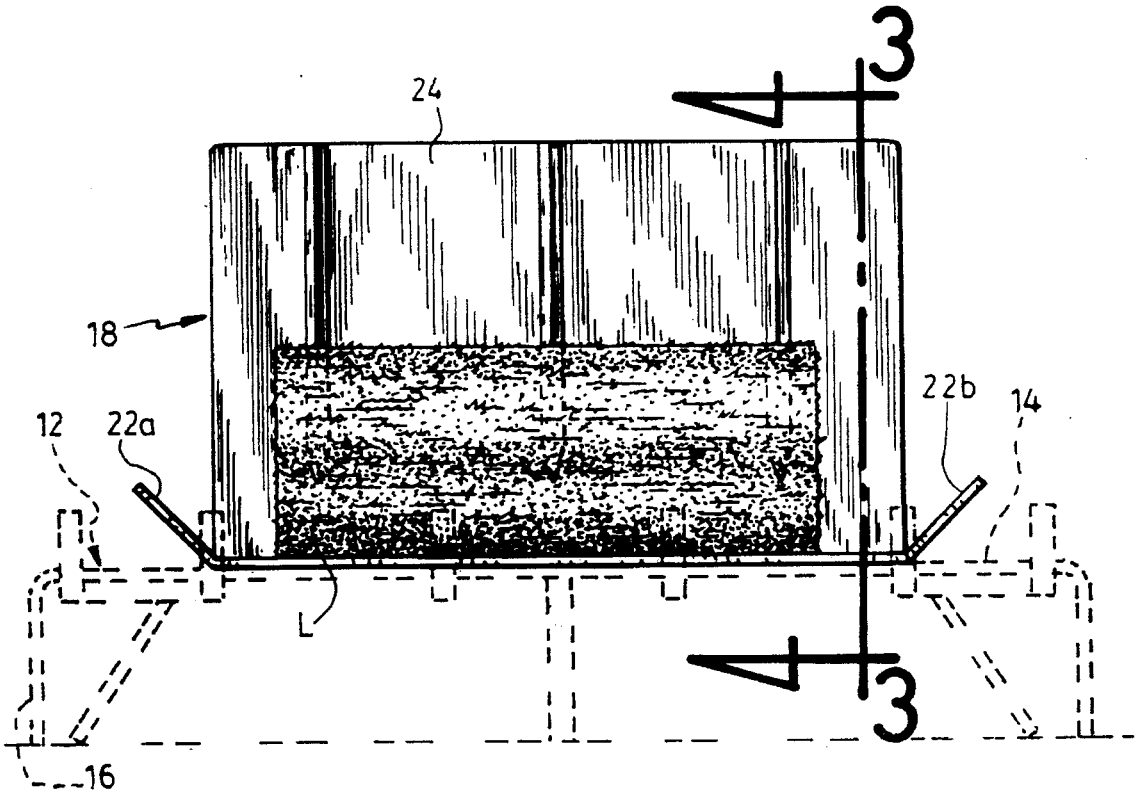
FIG. 2 is an enlarged front elevational view of the first embodiment of tray according to the invention, shown supporting a firelog and with a supporting andiron therebeneath illustrated in phantom lines.

As illustrated in FIG. 1, fireplace F consists of a recess R made into the upright wall W of a house, said recess opening upwardly to atmospheric air through a chimney duct (not illustrated). The flooring G of recess R is adapted to support an andiron, such as the one shown at 12 in dotted lines in FIG. 2. Andiron 12 forms an open, tubular, quadrangular template 14, supported in horizontal position over ground G by four corner legs 16.

According to the invention, there is provided a sheet tray 18, for fitting over the upper horizontal template 14 of andiron 12. Tray 18 consists of a single, generally quadrangular sheet of heat-reflecting metal, bent at right angle at an intermediate elbow section thereof, 20 (FIG. 3), to define a horizontal template 22 and an upright aft heat-reflector panel 24. Preferably, and as suggested in FIG. 2, horizontal template 22 is laterally wider than upright reflector panel 24, so as to define two opposite, free, lateral edge flanges 22*a*, 22*b*. Flanges 22*a*, 22*b*, are preferably upwardly outwardly inclined, while the main horizontal template 22 should be flat.

A single firelog L is to be supported flatly against the horizontal template 22, preferably abutting directly against the lower section of aftward upright panel 24. For best results, the upright sheet section 24 at the aft edge of the tray 18, should have a height A approximately twice that of the firelog L, as suggested in FIG. 3.

Figure 4:
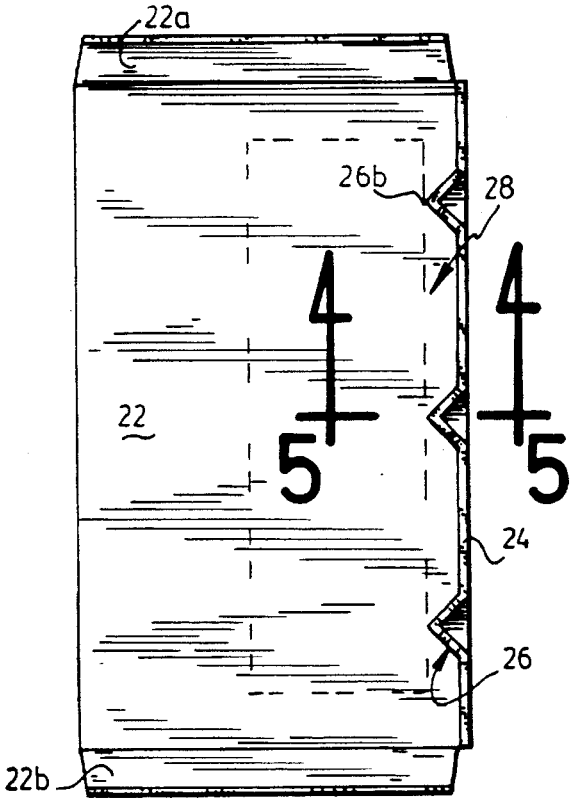
FIG. 4 is a top plan view of the first embodiment of tray, taken along line 4—4 of FIG. 3.

According to an important feature of the invention, and as best shown in FIG. 4, the upright panel 24 of firelog tray 18 has a generally wavy configuration. More particularly, in accordance with a preferred embodiment of the invention, the wavy configuration of upright wall 24 is in the form of cross-sectional V-shape integral ribs 26. Vertically elongated ribs 26 are preferably integral to the sheet section 24, being formed e.g. simply by using an industrial press to deform sheet 24 transversely thereof, as illustrated in the drawings, or as an add-on strip member welded in place. V-ribs 26 should be directed inwardly, i.e. in overhanging fashion relative to the horizontal sheet template 22. V-ribs 26 should be of a very small depth—preferably smaller than approximately four centimeters (4 cm) -, relative to the fore and aft width of the tray 18, so that a shallow airflow draft channel 28 be formed between each pair of successive V-ribs. Ribs 26 prevent packed log L from filling—and thus closing—air channel 28.

Figure 3:
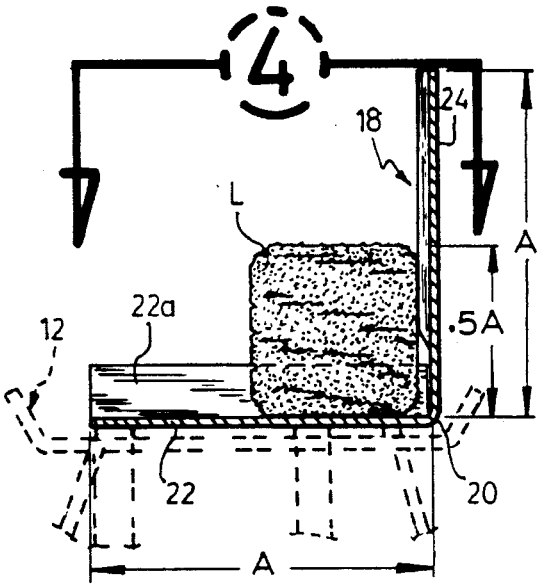
FIG. 3 is a sectional view taken along line 3—3 of FIG. 2.
Figure 5:
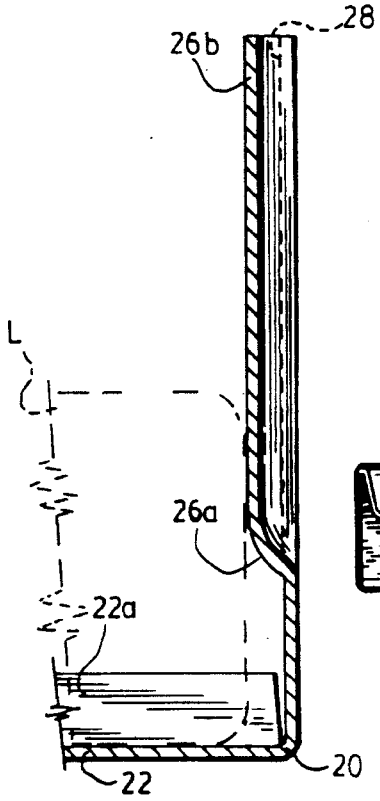
FIG. 5 is an enlarged, cross-sectional view taken along line 5—5 of FIG. 4, and cutting lengthwisely thorugh a reflector rib.
Figure 6:
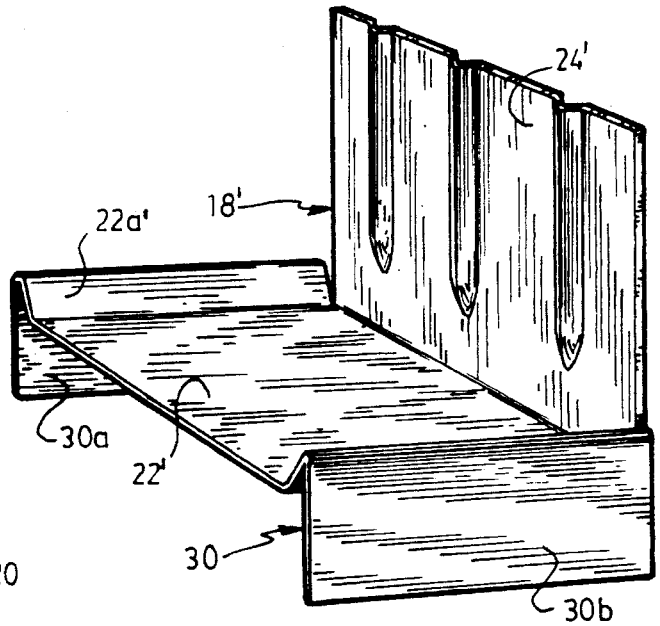
FIG. 6 is an isometric view of a second embodiment of firelog burner tray according to the invention.
Figure 7:
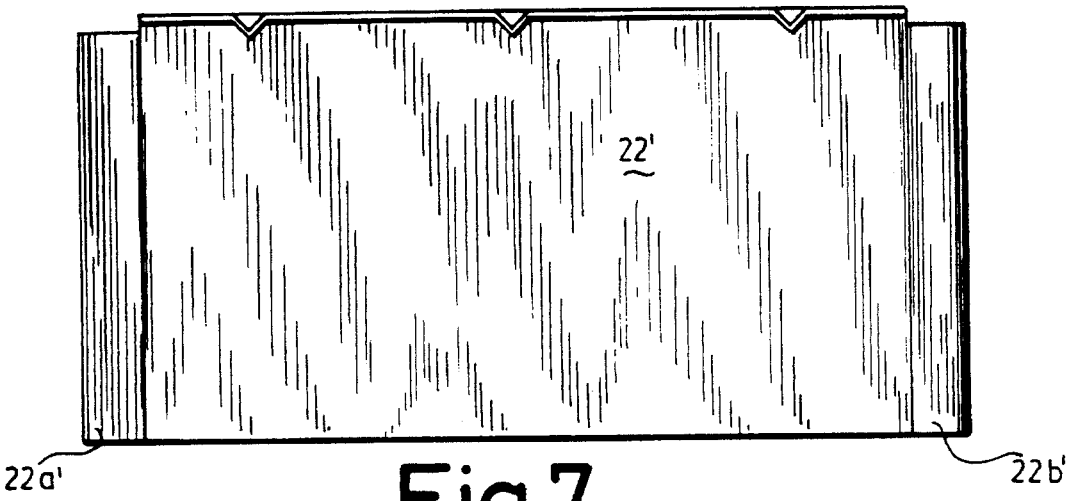
FIGS. 7, 8 and 9 are a top plan view, a front elevational view, and a lateral side elevational view, respectively, of the second embodiment of firelog burner.
Figure 8:
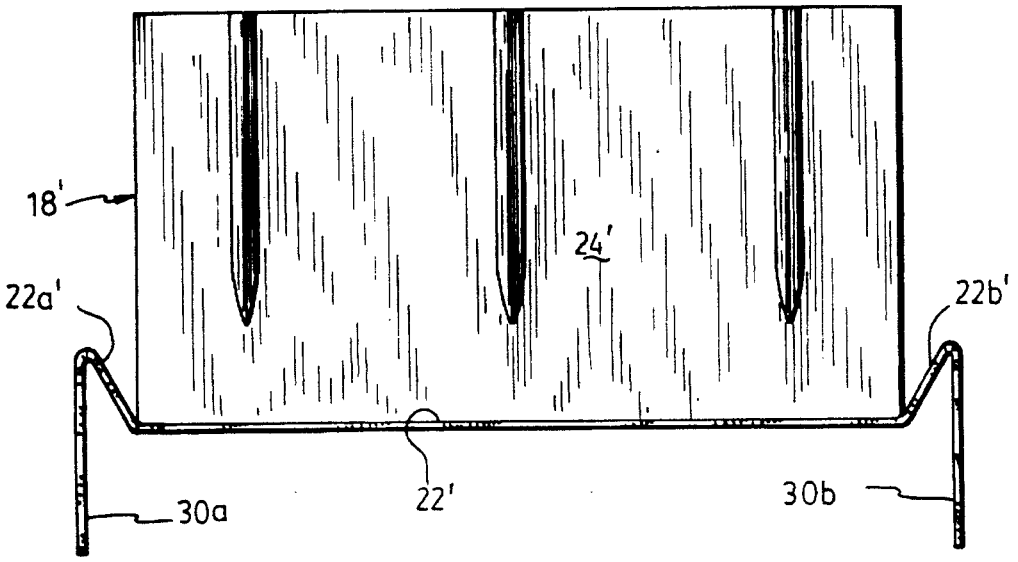
Figure 9:
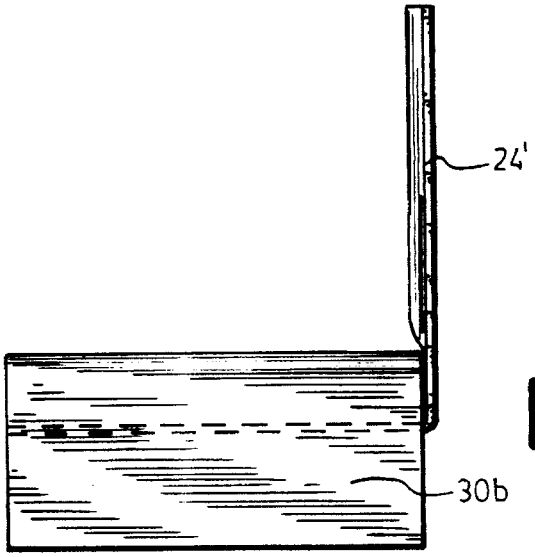

Preferably, and as best shown in FIGS. 3 and 5 of the drawings, the lower end 26*a* of vertical elongated V-ribs 26 will extend short of the horizontal sheet template 22, so that ends 26*a* be located at a height intermediate that of the firelog L supported over support sheet 22.

Accordingly, horizontal, transverse air flow may occur beneath V-ribs bottom end 26*a*, as suggested in FIG. 5. Three equally spaced vertical V-ribs 26 are shown in FIG. 4, although there could be two, four, five or more such ribs 26, provided there is sufficient distance between any two successive ribs 26, 26, to allow vertical flow of air between upright main sheet 24 and log L, while preventing firelog L from engaging the main flat sheet surface 24. Four ribs 26 is the preferred number for the ribs 26, for best results. Ribs 26 need not be equidistant.

It can now be understood from the foregoing that with such a firelog tray configuration, and with the selected aft corner location of the firelog L against the tray 18, the air required for combustion of the firelog L will be able to reach the firelog L about all faces thereof except the bottom face thereof, since firelog L rests flatly against the flat horizontal sheet section 22. Upright reflector panel 26 will reflect combustion heat forwardly.

Most ashes generated by the progressive combustion of the firelog L will then remain over the full template 22, without becoming airborne and without being brought upwardly with the flames, because the template 22 is flat and full, and because combustion air drafts are of moderate value due to the small depth of the vertical air channels 28 formed between each pair of successive V-ribs 26. Therefore, air pollution is reduced by this control of particulate emissions, compared to ordinary firelog andirons.

The sheet material for tray 18 must be a heat-reflecting material. Preferably, this material will be metallic, with a thickness ranging approximately between three and six millimiters (3–6 mm). The tray 18 may have for example the following dimensions: 41 cm wide for the template 22 (including the two upwardly inclined lateral flanges 22*a*, 22*b*), and 36 cm wide for the reflector panel 24.

The present tray 18 is designed to support one firelog L at a time, for best results; although it would obviously still be effective, albeit in a less efficient fashion, with more than one firelog. The combustion period with the present tray 18 will be substantially increased, while forward heat transfer toward and into the fireplace room (ahead of the fireplace) will nonetheless be enhanced.

The second alternate embodiment of fire tray, 18', illustrated in FIGS. 6 to 9, is identical to the first embodiment 18, except that support leg members 30 are added to the tray 18' (corresponding reference numerals are primed). Leg members 30 enable self support of tray 18' over the fireplace flooring G, to bring horizontal template to a location spacedly over ground, so that the andiron can be disposed of. Preferably, leg members 30 consist of a pair of edgewise sheet extensions 30*a*, 30*b*, which are carried transversely of flanges 22*a*', 22*b*'. Flat sheet extensions 30*a*, 30*b*, extend generally parallel to one another, as illustrated, but may also slightly converge, or preferably diverge, downwardly from one another, provided they ensure firelog stability over ground. Flat sheet extensions 30*a*, 30*b*, should extend generally orthogonally to the plane of horizontal support plate 22', so as to form two upright legs (see in particular FIG. 8).

The alternate embodiment of tray 18' should be used when no separate conventional andiron is available with the fireplace. Upright reflector panel 24' remains the same.

It is understood that whenever the expression "firelog" is used, it is meant to extend to any one of a variety of packed inflammable materials, not excluding ordinary wooden logs and artificial synthetic or semi-synthetic logs (e.g. logs made from a mixture of parrafine and sawdust).

I claim:

1. A firelog burner tray for supporting a straight, elongated wood-wax firelog of rectangular cross-section, said tray including:

(a) an apertureless, elongated flat base plate defining a substantially smooth upper surface and an aft longitudinal portion;

(b) an elongated heat-reflecting plate, upwardly extending from said aft longitudinal portion and making a right angle with said base plate; and (c) at least two elongated ribs, extending forwardly over said base plate member and longitudinally along said heat-reflecting member and laterally spacedly from one another;

wherein first air channel means of restricted cross-sectional area are formed between each pair of laterally successive said elongated ribs, said heat-reflecting plate and said firelog when it rests on said base plate and abuts against said ribs, for promoting vertical circulation of combustion air between said heat-reflecting member and said firelog;

said elongated ribs extending short of said base plate and thus defining lower ends spacedly located above said base plate, said heat-reflecting plate being apertureless, second air channel means of restricted cross-sectional area being formed between said ribs lower ends, said base plate, said heat-reflecting plate and said firelog when said firelog rests on said base plate and abuts against said ribs, said second air channel means promoting horizontal circulation of combustion air between said heat reflecting plate and said firelog; said base plate defining laterally opposite side edges, said tray further including a pair of flanges; each flange of said pair of flanges edgewisely depending from a corresponding one of said side edges, said flanges being outwardly upwardly inclined; the degree of inclination of said flanges controling at least partially the combustion air supply through said second air channel means.

2. A tray as defined in claim 1, further including support means, for self-supporting said base plate spacedly over ground.

3. A tray as defined in claim 2, wherein said support means consists of a pair of sheet extension lips that each transversely depends from a respective one of said flanges integrally thereof, said lips being substantially orthogonal to said base plate, whereby said lips are adapted to form upright support legs.

4. A tray as defined in claim 1, wherein each said upwardly inclined flange has an uppermost edge which is located within a horizontal plane which is downwardly offset relative to said ribs lower ends, to promote horizontal access of combustion air to said second air channel means.

* * * * *